US005979327A

United States Patent [19]

Thomson

[11] Patent Number: 5,979,327

[45] Date of Patent: Nov. 9, 1999

[54] METHOD AND APPARATUS FOR BLASTHOLE STEMMING

[75] Inventor: Stephen Thomson, Merewether, Australia

[73] Assignee: Orica Australia Pty Ltd, Melbourne, Australia

[21] Appl. No.: 09/066,427

[22] PCT Filed: Nov. 1, 1996

[86] PCT No.: PCT/AU96/00690

§ 371 Date: Jun. 26, 1998

§ 102(e) Date: Jun. 26, 1998

[87] PCT Pub. No.: WO97/17588

PCT Pub. Date: May 15, 1997

[30] Foreign Application Priority Data

Nov. 3, 1995 [AU] Australia ..... PN6377

[51] Int. Cl.[6] ..... F42B 3/00

[52] U.S. Cl. ..... 102/333

[58] Field of Search ..... 102/333

[56] References Cited

U.S. PATENT DOCUMENTS

| | | | |
|---|---|---|---|
| 1,642,118 | 9/1927 | Lindner | 102/333 |
| 1,751,015 | 3/1930 | Mora | 102/333 X |
| 1,772,994 | 8/1930 | Halverson | 102/333 |
| 5,092,245 | 3/1992 | Douglas et al. | 102/333 X |

FOREIGN PATENT DOCUMENTS

| | | | |
|---|---|---|---|
| 30436/92 | 7/1993 | Australia . | |
| 41210/93 | 12/1993 | Australia . | |
| 41907/93 | 1/1994 | Australia . | |
| 320765 | 10/1929 | United Kingdom | 102/333 |
| 812888 | 5/1959 | United Kingdom . | |
| 2 211 587 | 10/1988 | United Kingdom . | |

*Primary Examiner*—Peter A. Nelson

*Attorney, Agent, or Firm*—Pillsbury Madison & Sutro LLP

[57] ABSTRACT

A device and process for plugging an explosives blasthole, the device having an inner member (7*a*, 7*b*) in the form of a conduit having a valve (9) and being adapted for the passage of fluid bulk explosives and an outer member (1) adapted to engage the walls of the blasthole. The outer member may be made of deformable material or be inflatable. The inner and outer members may be detachable.

9 Claims, 4 Drawing Sheets

METHOD AND APPARATUS FOR BLASTHOLE STEMMING

Figures 1A, 1B, 1C:
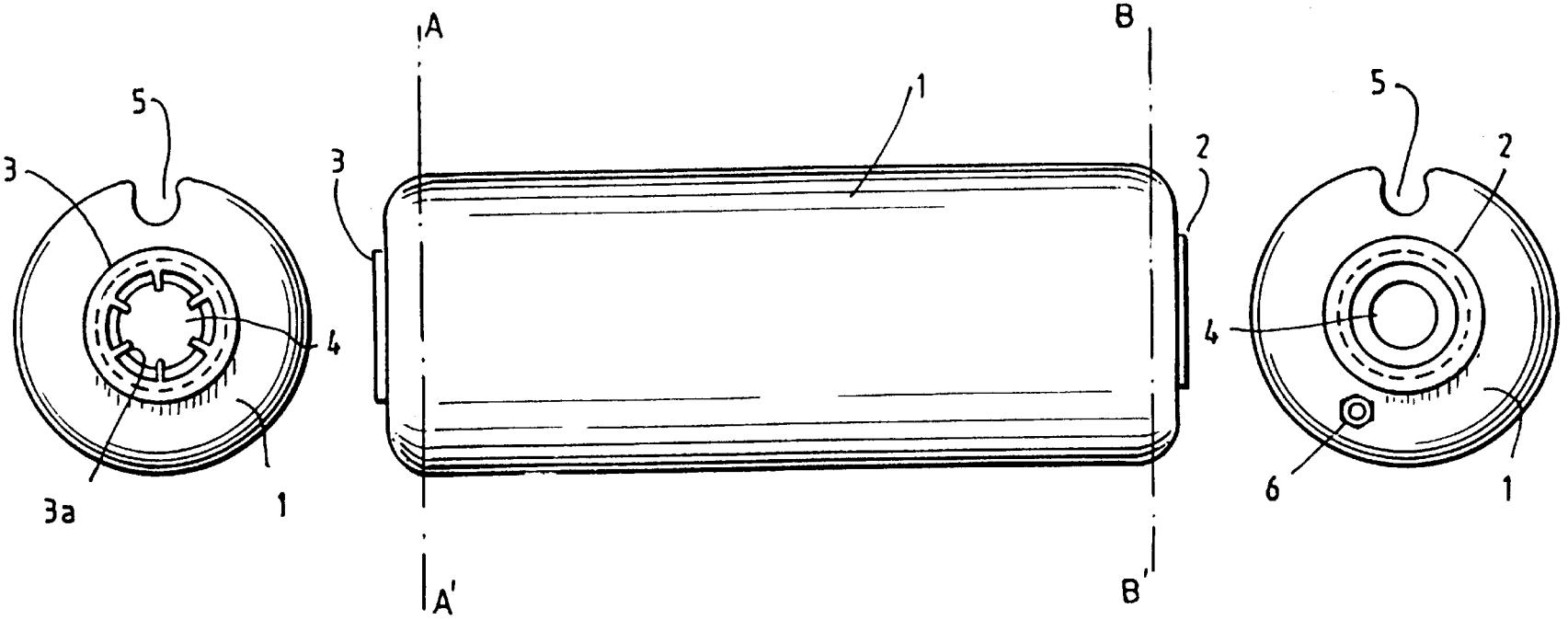

This application is the national phase of international application PCT/AU96/00690 filed Nov. 1, 1996 which designated the U.S.

The present invention relates to a method and apparatus for use in charging blastholes.

In mining operations the main objective of blasting is to break rock and shift material in a useful way. When an explosive charge explodes there is a powerful force exerted in all directions and any earth surrounding the explosive charge will break along the line of least resistance. In order to achieve an optimal result in blasting the location and degree of confinement of an explosive charge must be carefully designed. In mining applications this generally consists of locating explosive charges in blastholes drilled in ore, rock, coal or the like. Factors such as the diameter, length, angle and spacing of the blastholes are critical to the success of a blast.

Charging a newly drilled blasthole with explosives generally involves careful placement of an initiation device such as a detonator, a primer and bulk and/or packaged explosives. Detonators are small, compact high energy explosives which can initiate a larger body of explosive such as a primer which in turn may detonate with enough force to initiate bulk or packaged explosives. The nature, quantity and arrangement of the initiation device, primer and bulk or packaged explosives in a blasthole has a large influence on the results of a blast.

Often the blasthole is not completely filled with explosive charges. Often there is a gap between the top of the column of explosive charge and the collar of the blasthole which is either left open or filled with non-explosive material called stemming. The column itself may not necessarily be continuous; sometimes the column comprises several charges or short columns separated by inert material or devices referred to as decks are inserted into blastholes to provide discontinuities in the column of explosive. Decking tends to lower the explosion pressure in a blasthole and provide a more even distribution of energy than can be achieved in the absence of decking.

In the past many attempts have been made to provide a plugging device which can perform the function of air decking and/or stemming. For example attempts have been made to stem blastholes using polymeric containers filled with water and sealed closed at each end. One end is well rounded for easy insertion of the containers into the blasthole where they are secured in place by driving a wedge made of wood or plastic material between the container and the blasthole wall. This type of stemming is inconvenient to use because of the difficulty of manually forcing a water filled container into a blasthole and then driving in wedges while avoiding rupturing the container. These containers are particularly difficult to place into upholes.

Australian Patent Application No. 41907/93 describes an inflatable plugging device for stemming blastholes. This particular device comprises a flexible, inflatable body member which is contained within an inflexible container. Inflation of the flexible member acts to engage the walls of a blasthole to keep the device in place and maintain suspension of the stemming. This device however does not necessarily eliminate the use of stemming material and it is not always possible for a preformed, inflexible container to conform to the irregular cross section of a blasthole and thus form a seal.

Blastholes are commonly charged with bulk explosives by pumping or pneumatically conveying the bulk explosive through a loading hose into the blasthole. One of the drawbacks of most of the plugging devices of the prior art is that when such devices are used for decking, it is necessary to interrupt the charging of the blasthole with explosive in order to put the plugging device in place. When charging a deep blasthole full of emulsion explosive it is very inconvenient and inefficient to have to cease pumping or pneumatically conveying the emulsion and remove the loading hose in order to insert a plugging device. This method of operation is particularly inconvenient when charging upholes where the bulk emulsion already in the blasthole starts to slowly flow out of the hole under the influence of gravity before the plugging device is pushed into place.

It has now been found that a plugging device can be provided which can be placed in position in a blasthole prior to charging and bulk explosives pumped through the device.

The present invention provides a device for plugging a blasthole which device comprises:

(i) an inner member comprising a conduit for the passage of fluid bulk explosives material said conduit including a valve means adapted to allow passage of the explosives material in only one direction; and (ii) an outer member adapted to engage the walls of the blasthole.

The inner member essentially comprises a conduit or passage with an opening or inlet port at one end and an opening or outlet port at the other end through which fluid bulk explosive may be passed. A valve prevents back flow of fluid bulk explosive.

The outer member performs the function of bracing the plugging device against the walls of a blasthole such that the device forms a good seal with the blasthole walls and is prevented from slipping out of the blasthole. Clearly it is preferable that the outer member substantially conforms to the general shape of the blasthole.

In a preferred embodiment, the outer member is constructed of a deformable material which provides good contact between the device and the walls of the blasthole. Suitable materials include natural polymeric materials such as rubber, synthetic polymers such as expanded polyurethanes or expanded polystyrenes, neoprene and the like.

The outer member may also be inflatable so that the plugging device can be easily pushed into place along a blasthole and then the outer member inflated so as to provide good contact with the blasthole walls. The outer member may be inflated by a source of fluid material located externally such as a cylinder of gas or liquid which is kept under pressure or a reservoir of liquid which may be pumped into the flexible container. Depending on the fluid used it may be possible to pressurise the outer member. The flexible container may comprise a filling means such as a non-return valve, bleed valve, needle valve or any other convenient means for controlling fluid flow.

The fluid material for inflating the flexible container may be any convenient matter and includes liquids, gases or finely divided particulate matter. Water and air are particularly inexpensive and convenient fluid materials.

In a preferred embodiment of the plugging device of the present invention the outer member and the inner member comprise separate elements which may be assembled to give the plugging device of the present invention.

In such a preferred embodiment, preferably the outer member comprises a flexible container in the shape of cylinder comprising an essentially tubular conduit or passage along its axis or a flexible container in the shape of a toroid. The outer member may form an inflatable vessel or bag, the surface of which defines a cylinder comprising an essentially tubular conduit or passage along its axis or an inflatable vessel or bag the surface of which defines a toroid.

The inner member of such a preferred embodiment of the present invention comprises a tube or conduit adapted to be fitted into the essentially tubular conduit or passage in the outer member and which includes a valve means. Such an inner member may be conveniently referred to as a "liner" as it in effect "lines" the conduit or passage in the outer member when the inner and outer members are assembled to form the plugging device of the present invention.

In a particularly preferred embodiment the liner is tubular in shape and integral with the valve means. One end of the liner may comprise the inlet port, while the other end of the liner comprises the outlet port. The inlet port may be adapted for attachment of the explosives loading hose or alternatively the loading hose may be passed through the inlet port, part way into the passage or liner.

Preferably the valve means of the device of the present invention is located at the end of the liner nearest the outlet. The liner may be adapted to allow limited movement of a ball within the sleeve and thus form a ball valve. The movement of the ball may be limited by tapered fins protruding from the inner wall of the liner or a cage or the like. The liner and/or valve means may be constructed of any convenient material such as polymers.

The valve means of the device of the current invention permits fluid bulk explosive to be pumped through the passage of the plugging device into the blasthole but prevents any fluid bulk explosive flow in the opposite direction by sealing off the passage. Where the plugging device is being used in upholes, the hydrostatic head should be sufficient to cause the valve to close off the passage.

In general, the plugging device of the current invention is located in place in a blasthole and fluid bulk explosive is pumped or pneumatically conveyed into the blasthole. Initially the bulk explosive passes through the plugging device to fill the space between the end of the blasthole and the plugging device. As this happens, air is displaced and it may be necessary to provide means such as a bleed tube by which the air can vent from the blasthole. In a preferred embodiment the device of the current invention is provided with a channel for a bleed tube. It will be apparent to those skilled in the art that an air bleed tube will not be required in broken ground or in open holes from which displaced air can readily escape.

The current invention also provides a method of charging a blasthole using the device of the current invention. The method comprises the steps of:

(a) placing initiating explosives and optionally a bleed tube in a blasthole;

(b) inserting the end of an explosive loading hose into the plugging device of the current invention;

(c) locating the plugging device in place in the blasthole;

(d) pumping fluid bulk explosive into the blasthole; and (e) removing the loading hose.

The plugging device may be pushed into place in the blasthole using the end of the loading hose.

The plugging device of the current invention can be used at any position within a blasthole or for any convenient purpose. For example, the plugging device of the current invention can be used instead of stemming material or to hold stemming material in place. The stemming device can also be used in a decked blasthole between charges of explosives or between stemming material and explosives charges.

Where the plugging device is used to stem the blasthole the current invention provides a further method of charging a blasthole. The method comprises the steps of:

(a) placing initiating explosives and optionally a bleed tube in a blasthole;

(b) inserting the end of an explosive loading hose into the plugging device;

(c) locating the plugging device of the current invention in place at or near the collar of the blasthole;

(d) pumping fluid bulk explosive into the blasthole; and (e) removing the loading hose.

Where the plugging device of the current invention is used in a decked blasthole to separate charges of explosives from each other or separate explosives charges from inert material, the current invention provides a further method of charging a blasthole. The method comprises the steps of:

(a) placing initiating explosives and optionally a bleed tube in a blasthole;

(b) part charging the blasthole with explosives composition or inert material;

(c) locating a plugging device of the current invention in place in the blasthole;

(d) repeating step (b) and step (c) until the blasthole is filled.

Commonly in the above method of charging a blasthole the explosives composition would be pneumatically conveyed or pumped into the blasthole through a loading hose but it may be tipped or augered into the blasthole. The inert material may be any suitable non-explosive material known in the explosives field such as raw soil, gravel, sand and the like. The inert material may be charged into the blasthole by any convenient means including pneumatic conveying or pumping.

In a preferred embodiment of the above method, the end of an explosives loading hose or stem material loading hose is inserted into the plugging device of the current invention, the plugging device is located in place in the blasthole and explosives composition or stemming material is pumped through the plugging device.

Figure 2:
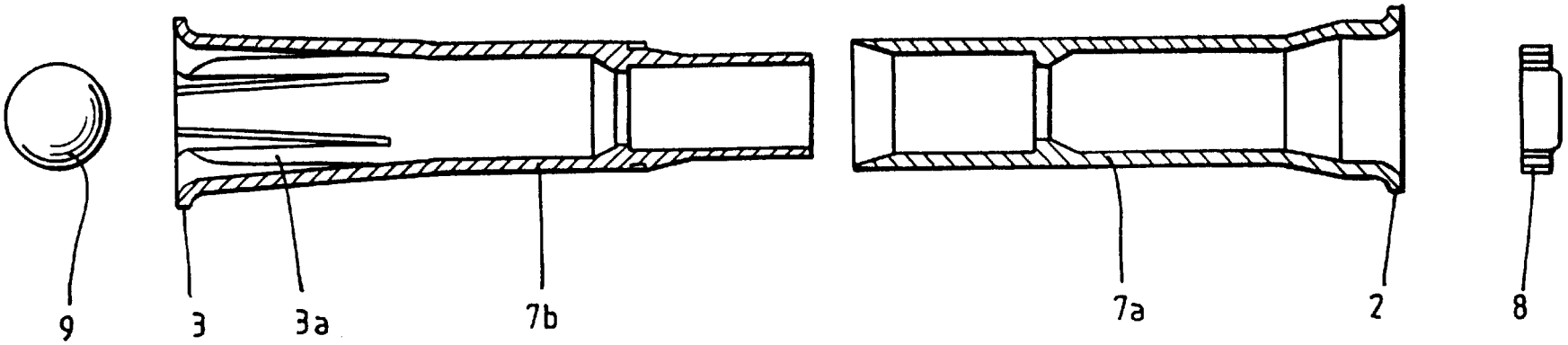
Figure 3:
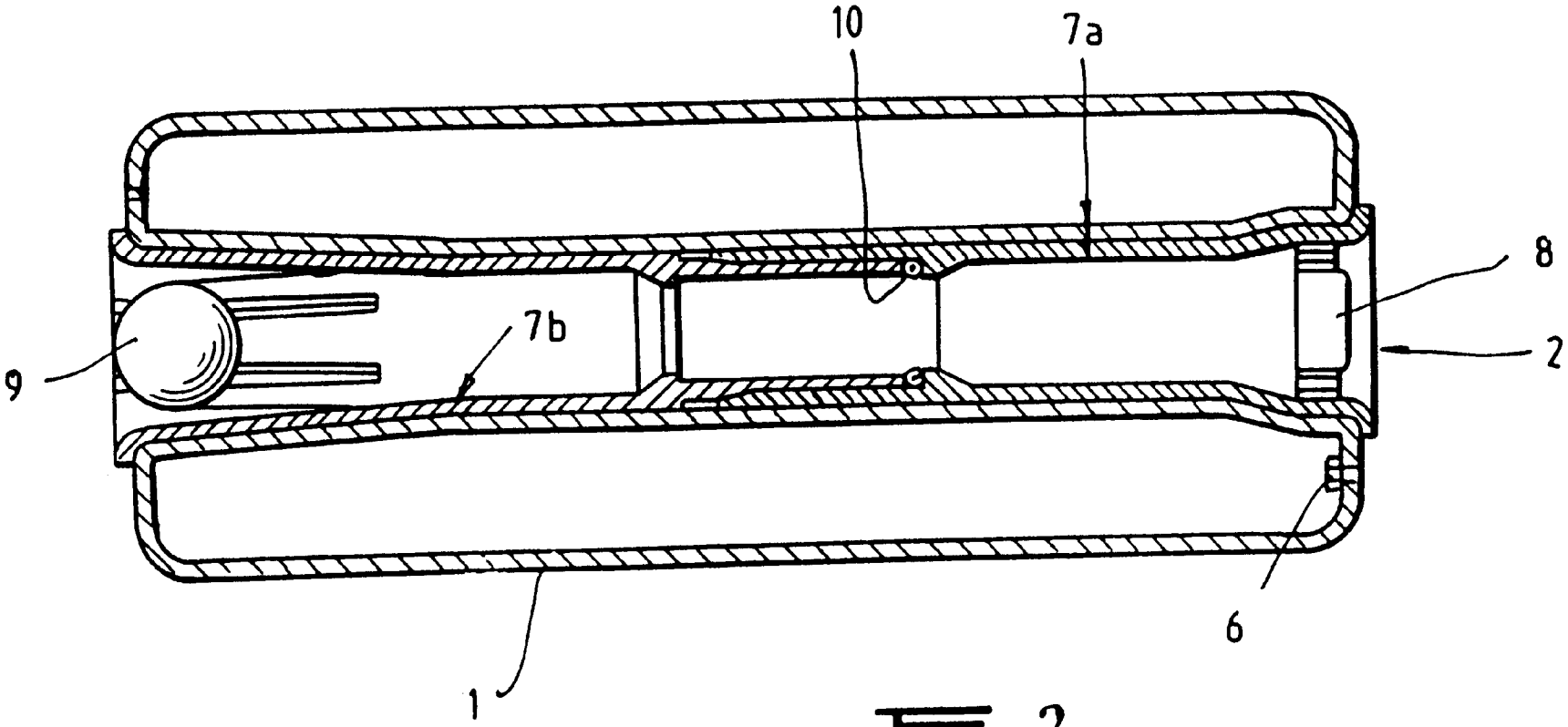
Figure 4:
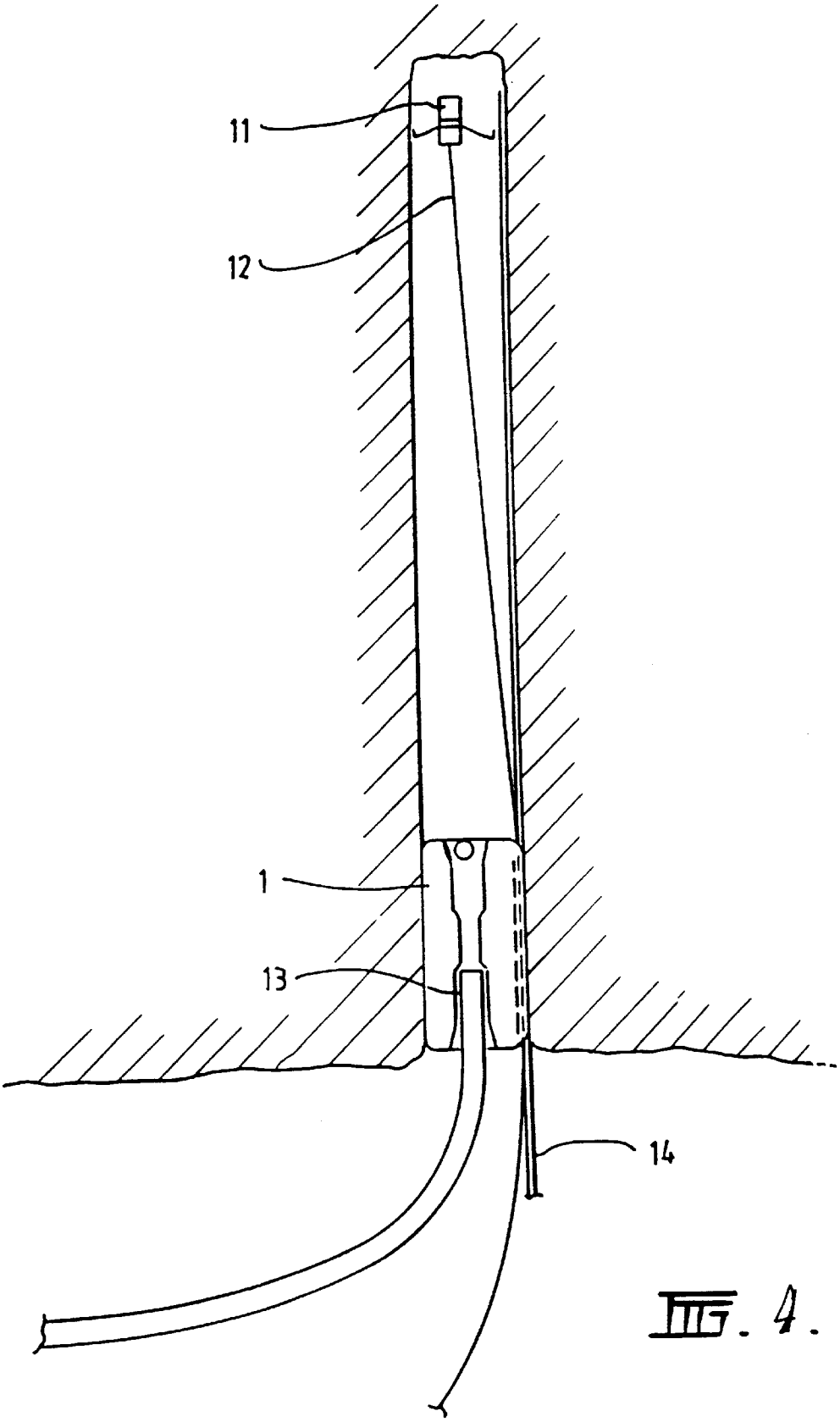

The method and device of the current invention will now be further described with reference to the drawings. FIG. 1 depicts one embodiment of the outer member of the plugging device of the current invention, FIG. 2 is a longitudinal cross section of the liner of the plugging device, dismantled to show its constituent members and FIG. 3 is a cross section of the assembled plugging device. FIG. 4 depicts the device of the current invention in use.

FIG. 1*a* shows the outward appearance of one embodiment of the outer member (1) of the plugging device which is generally cylindrical in shape and inflatable. The inlet port (2) and outlet port (3) can be clearly seen and are formed from the liner of the outer member. FIG. 1b is a view across the section AA' of FIG. 1*a* and shows the outlet port (3) and the passage (4) which passes between the inlet and outlet ports. Tapered fins (3*a*) prevent a ball valve in the liner from escaping from the passage. A channel (5) in the outer member (1) provides a conduit for a bleed tube. FIG. 1c is a view across the section BB' of FIG. 1*a* showing the inlet port (2), the passage (4) and the channel (5). A needle valve (6) is provided for inflation of the outer member.

FIG. 2 is a cross section of the liner of the plugging device of the current invention, dismantled to show its constituent pieces. The liner is generally tubular in shape, comprising two body members (7*a*, 7*b*) which can hold together by interference fit. The inlet port (2) may be fitted with an inlet seal (8). A ball (9) fits into the liner near the outlet port (3).

As fluid bulk explosive is pumped along the liner towards the outlet, the ball moves towards the outlet but is prevented from escaping the liner by the fins. The bulk explosive flows around the ball as the liner near the outlet is of greater diameter than the ball. As the blasthole fills with bulk explosive, the hydrostatic head of bulk explosive forces the ball away from the outlet, towards the parts of the liner of narrower diameter where the ball lodges, blocking the liner and preventing back flow of bulk explosive out of the plugging device.

FIG. 3 is a cross section of the assembled plugging device. The two body members of the liner (7*a*,7*b*), the ball (9) and inlet seal (8) can be seen located within the outer member (1). An o-ring (10) helps to seal around the hose used for pumping bulk explosive.

FIG. 4 depicts the plugging device of the current invention in place in an uphole. In practice, after a blasthole is drilled, a detonator attached to a length of signal tube (12) (or alternatively leg wires) is inserted into a primer (11). The primer is then located in position in a blasthole, preferably using a STOPEPRIME primer locater. (STOPEPRIME is a trade mark of ICI Australia Operations Proprietary Limited.) A bleed tube (14) is then positioned in the blasthole.

Next, a plugging device of the current invention is put in place near the collar of the blasthole and the outer member inflated using compressed air. Care is taken that the bleed tube passes along the channel in the outer member of the plugging device. It may be convenient (but not mandatory) that the signal tube also passes along the channel.

The end of an explosive loading hose (13) is inserted into the plugging device and used to push the plugging device into position in the blasthole. Fluid bulk explosive is then pumped through the plugging device into the blasthole. As the blasthole fills with explosive emulsion, air is displaced from the blasthole and escapes through the bleed tube. By the time the column of bulk explosive has risen from the collar area of the blasthole to the toe, the hydrostatic head of the column is sufficient to push the ball of the ball valve down and seal off the passage in the plugging device. The loading hose is subsequently removed and the blasthole is ready for detonation.

The plugging device of the current invention can be used as the sole means of plugging a blasthole or may be used in conjunction with other plugging means such as drill cuttings or the like. In some mining applications it may occur that the blasthole is open at both ends or that the toe of the blasthole is likely to break through surrounding or into a fissure, void, old tunnel or the like. In this situation it may be advisable to locate the plugging device of the current invention at the toe and the collar of the blasthole.

While the invention has been explained in relation to its preferred embodiments it is to be understood that various modifications thereof will become apparent to those skilled in the art upon reading the specification. Therefore, it is to be understood that the invention disclosed herein is intended to cover such modifications as fall within the scope of the appended claims.

The claims defining the invention are as follows:

1. A device for plugging a blasthole which device comprises:

(i) an inner member comprising a conduit for the passage of fluid bulk explosives material said conduit including a valve means adapted to allow passage of the explosives material through the said conduit in only one direction; and (ii) an outer member adapted to engage the walls of the blasthole.

2. A device according to claim 1 wherein the outer member comprises a deformable material.

3. A device according to claim 1 or claim 2 wherein the outer member is inflatable.

4. A device according to any one of claims 1 to 3 inclusive wherein the outer member and inner member comprise separate detachable elements.

5. A device according to any one of claims 1 to 4 inclusive wherein the outer member comprises a flexible container in the shape of a cylinder comprising an essentially tubular conduit along the axis and the inner member comprises a tube adapted to be fitted into the essentially tubular conduit in the outer member.

6. A device according to any one of claims 1 to 5 inclusive wherein the inner member comprises a ball valve.

7. A method of charging a blasthole comprising the steps of:

(a) placing initiating explosives and optionally a bleed tube in a blasthole;

(b) inserting the end of an explosive loading hose into a plugging device;

(c) locating the plugging device in place in the blasthole;

(d) pumping fluid bulk explosive through the inner member conduit into the blasthole; and (e) removing the loading hose.

8. A method of charging a blasthole comprising the steps of:

(a) placing initiating explosives and optionally a bleed tube in a blasthole;

(b) inserting the end of an explosive loading hose into a plugging device;

(c) locating the plugging device in place at or near the collar of the blasthole;

(d) pumping fluid bulk explosive into the blasthole; and (e) removing the loading hose.

9. A method of charging a blasthole comprising the steps of:

(a) placing initiating explosives and optionally a bleed tube in a blasthole;

(b) part charging the blasthole with explosives composition or inert material;

(c) locating a plugging device in place in the blasthole;

(d) repeating step (b) and step (c) until the blasthole is filled.

* * * * *

UNITED STATES PATENT AND TRADEMARK OFFICE

CERTIFICATE OF CORRECTION

PATENT NO. : 5,979,327

DATED : November 9, 1999

INVENTOR(S) : THOMSON

It is certified that error appears in the above-identified patent and that said Letters Patent is hereby corrected as shown below:

Title page "9 claims" should read --13 claims--.

Col. 6, line 15, change "any one of claims 1 to 3 inclusive" to --claim 1 or claim 2--;

line 18, change "any one of claims 1 to 4 inclusive" to --claim 4--;

line 24, change "any one of claims 1 to 5 inclusive" to --claim 1 or claim 2--;

line 25, change "inner member" to --valve means--;

line 36, change "hose." to --hose;--; and insert --wherein the plugging device is a plugging device according to claim 1--;

line 47, change "hose." to --hose;--; and insert --wherein the plugging device is a plugging device according to claim 1--;

line 56, change "filled." to --filled;--; and insert --wherein the plugging device is a plugging device according to claim 1--;

Please add the following new claims:

--12. A device according to claim 3 wherein the outer member and inner member comprise separate detachable elements.

UNITED STATES PATENT AND TRADEMARK OFFICE

CERTIFICATE OF CORRECTION

PATENT NO. : 5,979,327

DATED : November 9, 1999

INVENTOR(S) : THOMSON

It is certified that error appears in the above-identified patent and that said Letters Patent is hereby corrected as shown below:

13. A device according to claim 12 wherein the outer member comprises a flexible container in the shape of a cylinder comprising an essentially tubular conduit along the axis and the inner member comprises a tube adapted to be fitted into the essentially tubular conduit in the outer member.

14. A device according to claim 3 wherein the valve means comprises a ball valve.

15. A device according to claim 4 wherein the valve means comprises a ball valve.--

Signed and Sealed this

Nineteenth Day of December, 2000

*Attest:*

Q. TODD DICKINSON

*Attesting Officer*

*Commissioner of Patents and Trademarks*